US009643095B2

(12) United States Patent
Choi

(10) Patent No.: US 9,643,095 B2
(45) Date of Patent: May 9, 2017

(54) SPINNING TOP AND SPINNING TOP PLAY DEVICE USING SAME

(71) Applicant: Jong-Ill Choi, Seoul (KR)

(72) Inventor: Jong-Ill Choi, Seoul (KR)

( * ) Notice: Subject to any disclaimer, the term of this patent is extended or adjusted under 35 U.S.C. 154(b) by 0 days.

(21) Appl. No.: 14/900,687

(22) PCT Filed: Jul. 2, 2014

(86) PCT No.: PCT/KR2014/005890

§ 371 (c)(1),
(2) Date: Dec. 22, 2015

(87) PCT Pub. No.: WO2015/005608

PCT Pub. Date: Jan. 15, 2015

(65) Prior Publication Data

US 2016/0129354 A1 May 12, 2016

(30) Foreign Application Priority Data

Jul. 11, 2013 (KR) ..... 10-2013-0081781

(51) Int. Cl.

| | |
|---|---|
| ***A63H 1/00*** | (2006.01) |
| ***A63H 1/02*** | (2006.01) |
| ***A63F 9/16*** | (2006.01) |
| ***A63H 1/04*** | (2006.01) |

(52) U.S. Cl.

CPC ..... *A63H 1/02* (2013.01); *A63F 9/16* (2013.01); *A63H 1/00* (2013.01); *A63H 1/04* (2013.01)

(58) Field of Classification Search

CPC .... A63H 1/00; A63H 1/02; A63H 1/04; A63F 9/16

USPC ..... 446/233, 236, 256, 257, 259, 262, 263, 446/264

See application file for complete search history.

(56) References Cited

U.S. PATENT DOCUMENTS

| | | | | | |
|---|---|---|---|---|---|
| 299,703 | A * | 6/1884 | Volke | A63H 1/02 | 446/260 |
| 1,361,637 | A * | 12/1920 | Steen | A63H 1/02 | 446/259 |
| 1,368,040 | A * | 2/1921 | Lindstrom | A63H 1/02 | 446/260 |
| 3,623,262 | A * | 11/1971 | Noda | A63H 1/24 | 446/242 |

(Continued)

FOREIGN PATENT DOCUMENTS

| | | |
|---|---|---|
| JP | 9-322984 A | 12/1997 |
| JP | 2007-111144 A | 5/2007 |

(Continued)

OTHER PUBLICATIONS

International Search Report issued on Sep. 30, 2014 in counterpart International Application No. PCT/KR2014/005890 (5 pages with English translation).

*Primary Examiner* — Alexander Niconovich
(74) *Attorney, Agent, or Firm* — NSIP Law

(57) ABSTRACT

The present invention provides a spinning top employing a gyroscope to enhance the amusement at spinning top play, and a spinning top play device using the same such that, since a rotor of the spinning top is not exposed to the outside, an angular momentum of the rotor can be advantageously maintained for a long period of time even when collision occurs.

18 Claims, 15 Drawing Sheets

(56) References Cited

U.S. PATENT DOCUMENTS 3,646,703 A * 3/1972 Baginski ..... A63H 33/36 446/22
3,876,205 A * 4/1975 Drohomirecky ..... A63H 1/00 124/4
4,538,999 A * 9/1985 Orlowski ..... A63H 1/02 446/259
5,518,437 A * 5/1996 Nonaka ..... A63H 1/02 446/259
5,593,338 A * 1/1997 Itoh ..... A63H 1/02 446/259
6,530,817 B1 * 3/2003 Winslow ..... A63H 1/00 446/256
6,612,895 B2 * 9/2003 Sze ..... A63H 1/00 446/233
6,739,939 B2 * 5/2004 Matsukawa ..... A63F 3/00895 446/256
6,743,070 B1 * 6/2004 Lin ..... A63H 1/02 446/15
6,769,953 B1 * 8/2004 Sutton ..... A63H 1/02 446/256
7,740,518 B2 * 6/2010 Elliott ..... A63F 9/16 273/126 R
8,066,543 B2 * 11/2011 Kitamura ..... A63F 9/16 273/110
8,210,895 B2 * 7/2012 Bertrand ..... A63H 1/02 446/259
8,568,191 B2 * 10/2013 Rehkemper ..... A63H 33/003 273/108
8,920,209 B2 * 12/2014 Brooks ..... A63H 1/00 446/234
8,986,066 B2 * 3/2015 Ferreyra ..... A63H 1/02 446/259
9,186,591 B2 * 11/2015 Nielsen ..... A63H 1/20
2002/0102907 A1 * 8/2002 Osawa ..... A63H 1/00 446/256
2011/0006479 A1 * 1/2011 Ujita ..... A63H 1/16 273/147
2011/0171876 A1 * 7/2011 Ujita ..... A63H 1/00 446/264
2011/0256794 A1 * 10/2011 Horikoshi ..... A63H 1/04 446/259
2013/0324004 A1 * 12/2013 Schwartz ..... A63H 30/04 446/259
2015/0017872 A1 * 1/2015 Choi ..... A63H 1/04 446/259
2016/0175721 A1 * 6/2016 Choi ..... A63H 1/04 446/259

FOREIGN PATENT DOCUMENTS

JP 3144436 U 8/2008
KR 10-2011-0083364 A 7/2011

* cited by examiner

SPINNING TOP AND SPINNING TOP PLAY DEVICE USING SAME

CROSS REFERENCE TO RELATED APPLICATION(S)

This application is a National Phase entry of PCT Application No. PCT/KR2014/005890, filed on Jul. 2, 2014, which claims priority under 35 U.S. C. §119(e), 120 and 365(c) to Korean Patent Application No. 10-2013-0081781, filed on Jul. 11, 2013 in the Korean Intellectual Property Office, the entire disclosures of each of which are incorporated herein by reference for all purposes.

TECHNICAL FIELD

The present invention relates to a spinning top and a spinning top play device using the same, and more particularly, to a spinning top employing a gyroscope to enhance amusement at the spinning top play, and a spinning top play device using the same.

BACKGROUND ART

Typical spinning tops are made of conical wood, and have a lower end fitted with a metal ball fitted into a lower end thereof, or a screw with a semi-spherical head.

In case of the wooden spinning top, a lot of effort to machine a main body and fit the ball is required. In addition, if impact is applied to the main body from the exterior, the main body is likely to be cracked or broken. Therefore, since the main body has been recently made of synthetic resin through injection molding, spinning tops of synthetic resin which can be easily made and improve the durability are widely released.

In case of top-spinning games, there are some methods of competing with each other to run in first from a target point of 5 to 10 m in front of a start line, hitting spinning tops to topple the opponent spinning top, and so forth.

Korea Utility Model Publication No. 20-439845 discloses a spinning top including a rotor, a rotating shaft fixed to the rotor, at least one holder provided to the outside of the rotating shaft, and at least one rotation tip detachably connected to the holder.

The spinning top disclosed in the publication has a drawback in that since the rotor is exposed to the outside, if the spinning rotor directly collides with other spinning rotor in the top-spinning game, a rotation force is likely to be decreased, which cause the interest in the top-spinning game to reduce.

DISCLOSURE

Technical Problem

Accordingly, the present invention has been made in view of the above mentioned problems, and an object of the present invention is to provide a spinning top employing a gyroscope to enhance amusement at the spinning top play, and a spinning top play device using the same.

Technical Solution

To accomplish the above-mentioned object, according to a first aspect of the present invention, there is provided a spinning top including: an outer rotor which has an accommodation space therein, and is provided with a plurality of winder receiving holes through which a winder passes; an inner rotor which is installed in the outer rotor and is rotated around a rotation shaft in the outer rotor; and the winder which is provided with a rack gear formed on one side thereof, the winder being inserted through a winder receiving hole of the outer rotor and being meshed with the inner rotor to provide the inner rotor with a rotation force to be able to rotate in the outer rotor, in which the outer rotor is rotated by a centrifugal force of the inner rotor.

In addition, the spinning top according to the present invention is characterized by further including an auxiliary top which receives the outer rotor and is rotated by at least one of rotation of the outer rotor and rotation of the inner rotor.

In addition, the spinning top according to the present invention is characterized in that the auxiliary top includes an outer rotor accommodating groove which receives the outer rotor; an auxiliary top rotation shaft which is provided at a bottom surface of the outer rotor accommodating groove; and an engaging boss which is provided at the outer rotor accommodating groove, and is engaged to the outer rotor which is received in the outer rotor accommodating groove, to transmit rotation of the engaged outer rotor to the auxiliary top.

In addition, the spinning top according to the present invention is characterized in that the auxiliary top includes an outer rotor accommodating groove which receives the outer rotor; an auxiliary top rotation shaft which is provided at a bottom surface of the outer rotor accommodating groove; and an engaging groove which is provided at the outer rotor accommodating groove, and is engaged to the rotation shaft which protrudes in a desired distance from the outer rotor, to transmit rotation of the engaged inner rotor to the auxiliary top.

In addition, the spinning top according to the present invention is characterized in that the outer rotor has engaging holes formed in upper and lower portion of a spherical or elliptical shape so as to engage with the auxiliary top, and each engaging hole has an engaging groove.

In addition, the spinning top according to the present invention is characterized in that the outer rotor has an rotation shaft support formed at an inner lower portion of a spherical or elliptical shape so as to support the rotation shaft of the inner rotor, and a rotation shaft through-hole formed in an inner upper portion of a spherical shape, through which a portion of the rotation shaft protrudes.

In addition, the spinning top according to the present invention is characterized in that the inner rotor includes the rotation shaft, a rotor installed to the rotation shaft, and a pinion gear installed to the rotation shaft to convert a linear motion of the winder into a rotary motion and then output it to the rotation shaft.

In addition, the spinning top according to the present invention is characterized in that the inner rotor includes the rotation shaft with an engaging boss of a desired shape formed at one side thereof, a rotor installed to the rotation shaft, a pinion gear installed to the rotation shaft to convert a linear motion of the winder into a rotary motion and then output it to the rotation shaft, and a stopper installed to one side of the rotation shaft to prevent the engaging boss of the rotation shaft from protruding outwardly over a desired distance from the outer rotor.

According to another aspect of the present invention, there is provided a spinning top including: an outer rotor which has an accommodation space therein; an inner rotor which is installed in the outer rotor and is rotated around a rotation shaft in the outer rotor, the rotation shaft penetrating the outer rotor; a top launcher which receives the outer rotor, and is formed with a plurality of winder receiving holes through which a winder passes, the top launcher being engaged to the rotation shaft of the inner rotor to convert a linear motion of the winder into a rotary motion and thus rotate the inner rotor; and the winder which is provided with a rack gear formed on one side thereof, the winder being meshed with the top launcher to provide the inner rotor with a rotation force to be able to rotate in the outer rotor.

In addition, the spinning top according to the present invention is characterized by further including an auxiliary top which receives the outer rotor and is engaged to the rotation shaft of the inner rotor.

In addition, the spinning top according to the present invention is characterized in that the auxiliary top further includes a collision ring which is detachably installed to an outer peripheral surface of the auxiliary top.

In addition, the spinning top according to the present invention is characterized in that the auxiliary top includes an outer rotor accommodating groove for receiving the outer rotor; an outer rotor seat which protrudes in a desired distance from a bottom surface of the outer rotor accommodating groove, and is provided with a rotation shaft receiving portion to be engaged to the rotation shaft of the inner rotor, the rotation shaft receiving portion being formed with a receiving groove; and a bottom which is installed to a lower portion of the outer rotor accommodating groove to form a rotation shaft of the auxiliary top.

In addition, the spinning top according to the present invention is characterized in that the outer rotor seat is formed integrally with a bottom engaging portion which is engaged to the bottom, and is detachably installed to the bottom surface of the outer rotor accommodating groove.

In addition, the spinning top according to the present invention is characterized in that the bottom is detachably installed to the outer rotor accommodating groove.

In addition, the spinning top according to the present invention is characterized in that the outer rotor is formed in a spherical shape or an elliptical shape, and is provided with at least one protrusion formed on an outer peripheral surface of the outer rotor.

In addition, the spinning top according to the present invention is characterized in that the inner rotor includes the rotation shaft, a rotor installed to the rotation shaft, and a bearing installed between the rotation shaft and the outer rotor.

In addition, the spinning top according to the present invention is characterized in that the top launcher includes a top launcher body which has an outer rotor receiving portion for receiving the outer rotor and a plurality of winder receiving holes into which the winder is inserted; a pinion gear which is rotatably installed in the top launcher body, and is provided with an engaging portion engaging to the rotation shaft of the inner rotor, and a pinion gear formed on an outer peripheral surface thereof; and an rotation shaft to support the pinion gear to be able to rotate in the top launcher body.

According to another aspect of the present invention, there is provided a spinning top play device including: a spinning top including an outer rotor with a receiving space therein, an inner rotor which is installed in the outer rotor, and has a rotor rotated around a rotation shaft in the outer rotor, and an auxiliary top which is engaged to the rotation shaft of the inner rotor, with a portion of the outer rotor being seated in the auxiliary top; a spinning top station body which is formed with a concave slope portion at a center thereof along which the spinning top moves; a plurality of spinning top seats which are installed to the spinning top station body, and have a plurality of supports on which the spinning top is seated; and a guide which connects the spinning top station body and the spinning top seat to guide movement of the spinning top seated on the spinning top seat to the spinning top station body.

Advantageous Effects

With the configuration of the spinning top according to the present invention, since the rotor of the spinning top is not exposed to the outside, the rotation force of the rotor can be kept for a long period of time even at the collision.

Also, the connection between the outer rotor and the auxiliary top can enhance the amusement at the spinning top play.

In addition, a plurality of spinning tops can be admitted to the spinning top station at the same time to collide with each other, thereby further enhancing the amusement at the spinning top play.

MODE FOR INVENTION

Hereinafter, preferred embodiments of a spinning top and a spinning top play device according to the present invention will be described in detail with reference to the accompanying drawings.

First Embodiment

Figure 1:
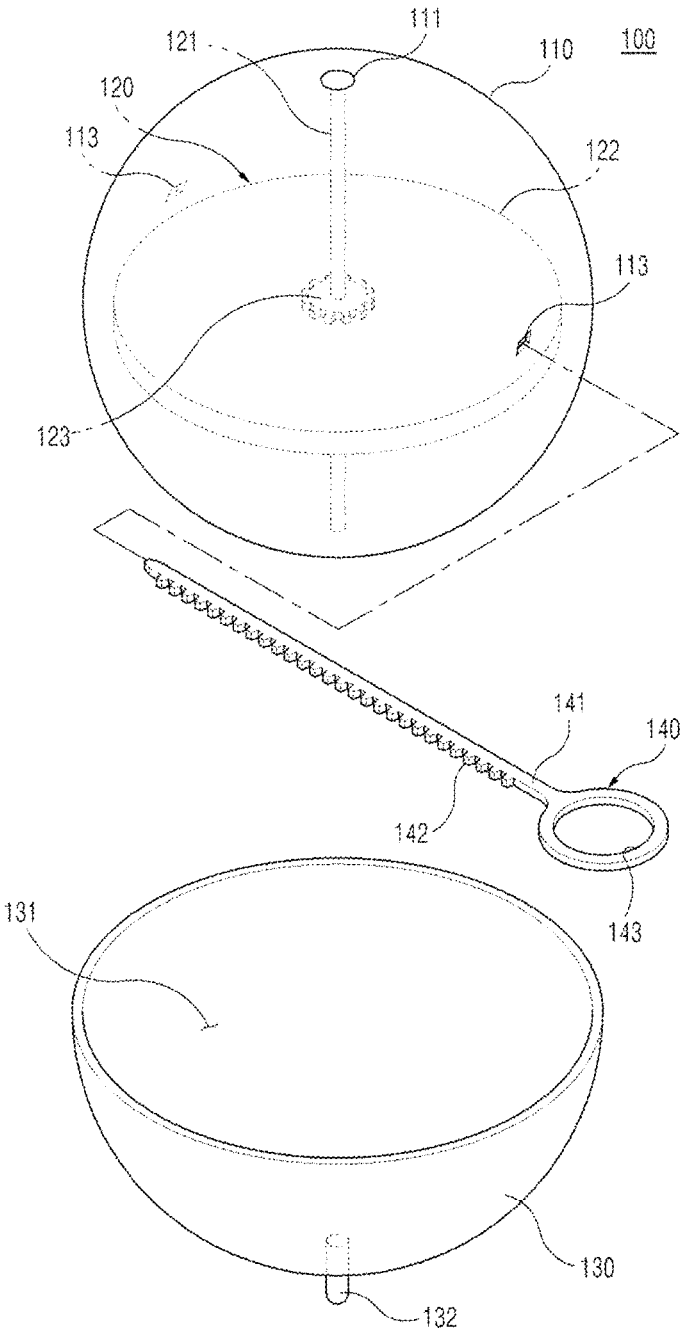
FIG. 1 is a perspective view illustrating a spinning top according to a first embodiment of the present invention.

FIG. 1 is a perspective view illustrating a spinning top according to the first embodiment of the present invention.

Figure 2:
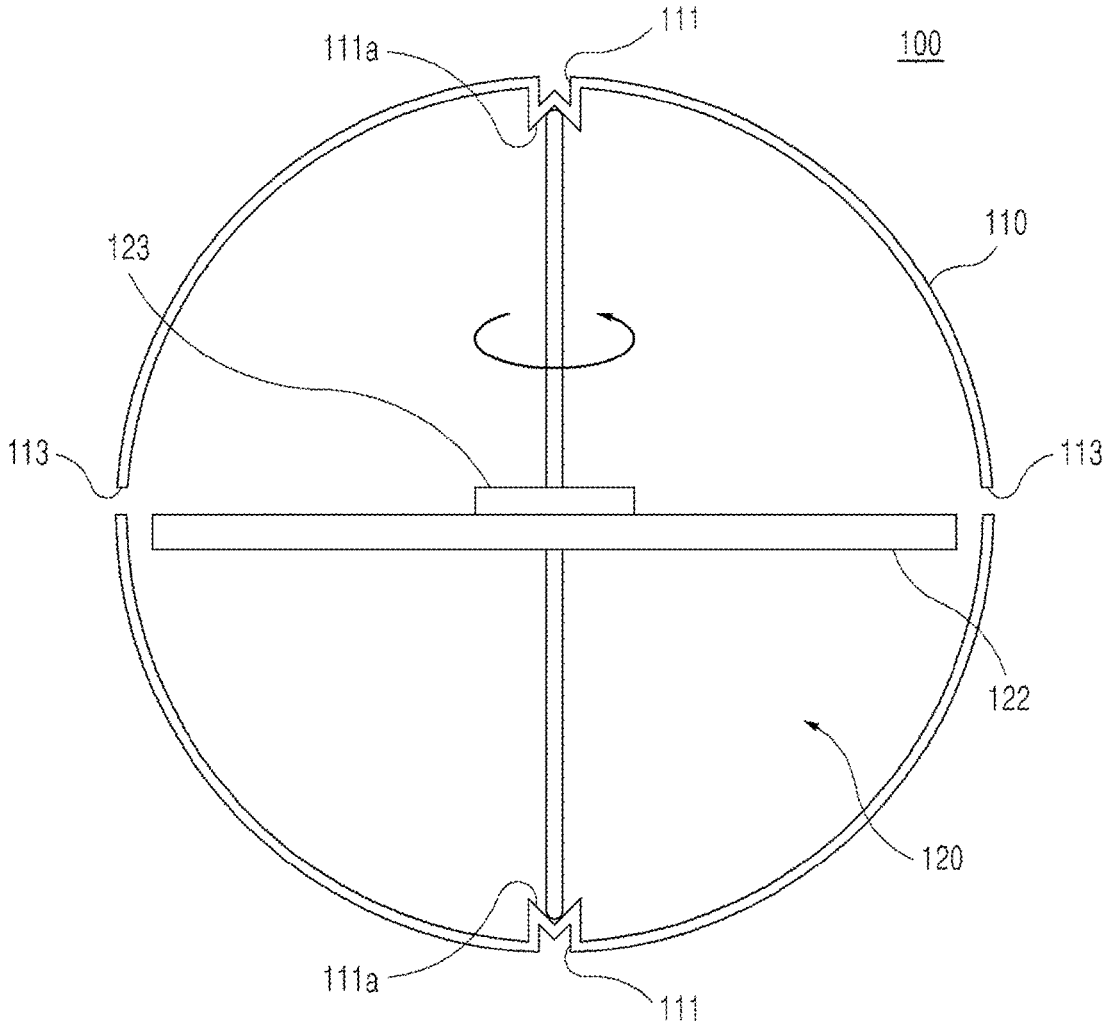
FIG. 2 is a cross-sectional view illustrating the configuration of an outer rotor of the spinning top in FIG. 1.
Figure 3:
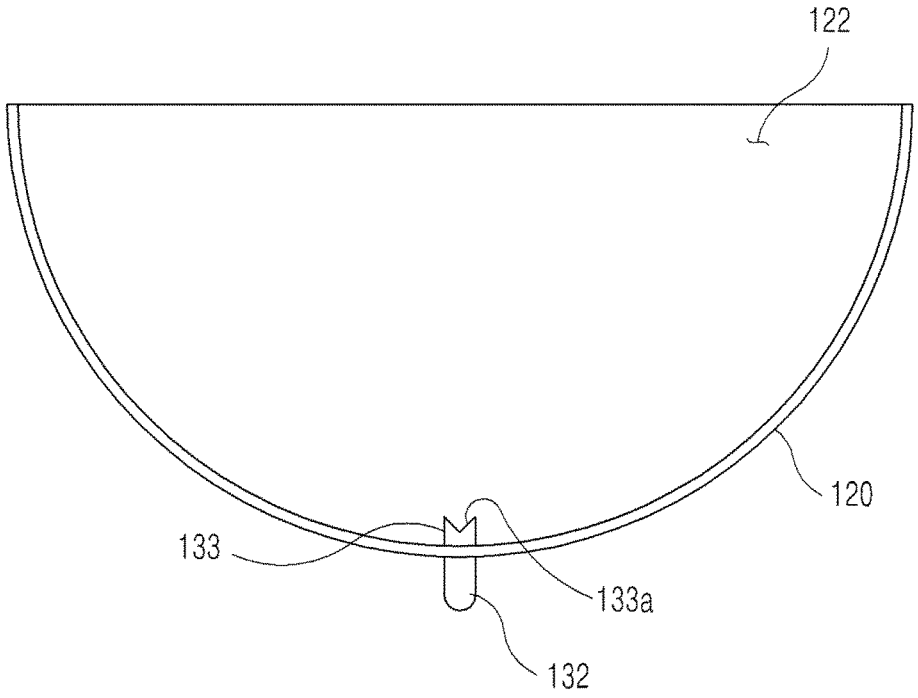
FIG. 3 is a cross-sectional view illustrating the configuration of an auxiliary top of the spinning top in FIG. 1.
Figure 4:
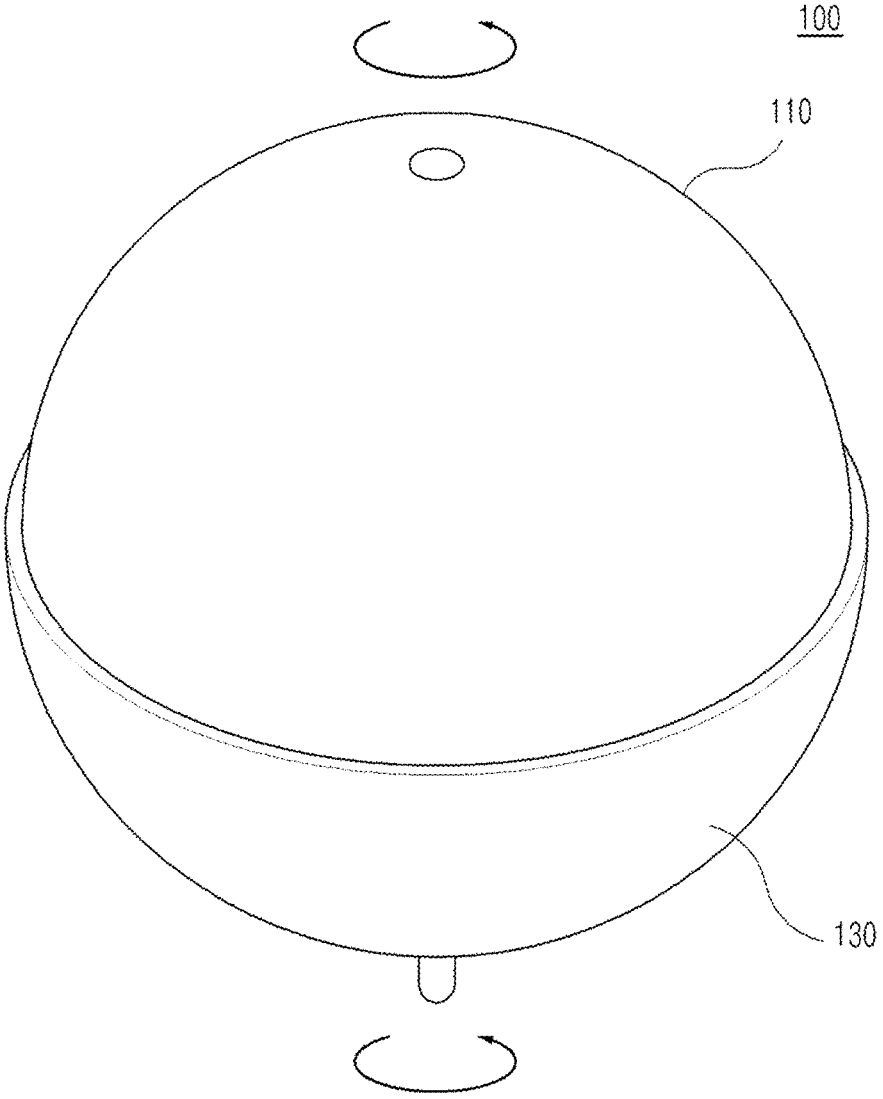
FIG. 4 is a perspective view illustrating the operation of the spinning top in FIG. 1.

FIG. 2 is a cross-sectional view illustrating the configuration of an outer rotor of the spinning top in FIG. 1. FIG. 3 is a cross-sectional view illustrating the configuration of an auxiliary top of the spinning top in FIG. 1. FIG. 4 is a perspective view illustrating the operation of the spinning top in FIG. 1.

As illustrated in FIGS. 1 to 4, a spinning top 100 according to the first embodiment includes an outer rotor 110, an inner rotor 120, an auxiliary top 130, and a winder 140.

The outer rotor 110 is a spherical member with an accommodation space therein, and is rotated by a centrifugal force of the inner rotor 120 installed therein.

Although in the first embodiment the shape of the outer rotor 110 has been explained to have the spherical shape for the sake of easy explanation, the present invention is not limited thereto. The shape may be applied to an elliptical shape or the like.

Also, the outer rotor 110 is provided with engaging holes 111 at the center of upper and lower portions, and each engaging hole 111 has an engaging groove 11*a* to which the auxiliary top 130 is engaged.

The engaging groove 111*a* is formed in a desired protruding shape so that the auxiliary top 130 is engaged to the engaging groove 111*a* to transmit a rotation force of the outer rotor 110 to the auxiliary top 130. A rotation shaft 121 of the inner rotor 120 is installed in the engaging grooves 111*a* to transmit the centrifugal force of the inner rotor 120 to the outer rotor 110.

Also, the outer rotor 110 is provided with a plurality of winder receiving holes 113 on a side thereof to receive the winder 140. The winder 140 is meshed with the inner rotor 120 installed in the outer rotor.

The inner rotor 120 is installed in the outer rotor 110 to be able to rotate therein, and has a disc-shaped rotor 122 installed to the rotation shaft 121. The rotor 122 is rotated in the outer rotor 110 on the basis of the rotation shaft 121 so as to create the centrifugal force, which causes the spinning top 100 to spin.

Also, the inner rotor 120 has a pinion gear 123 which is installed to the rotation shaft 121 and is meshed with a rack gear 142 of the wider 140 to convert a linear motion of the winder 140 into a rotary motion, so that the rotation shaft 121 is rotated.

The auxiliary top 130 is a hemispherical member with an accommodation space therein, and a portion of the outer rotor 110 is seated in the auxiliary top 130. The auxiliary top 130 is rotated by rotation of the outer rotor 110, and has an outer rotor accommodating groove 131, an auxiliary top rotation shaft 132, and an engaging boss 133.

The outer rotor accommodating groove 131 is a hemispherical space in which the lower portion of the outer rotor 110 is seated.

The auxiliary top rotation shaft 132 protrudes in a desired length from a bottom surface of the outer rotor accommodating groove 131. When the auxiliary top 130 is rotated by the centrifugal force of the outer rotor 110, the auxiliary top 130 rotates around the auxiliary top rotation shaft 132.

The engaging boss 133 upwardly protrudes in a desired length from the bottom surface of the outer rotor accommodating groove 131, and is engaged to the outer rotor 110 which is seated in the outer rotor accommodating groove 131.

An upper portion of the engaging boss 133 is formed with a patterned portion 133*a* which is fitted into the engaging groove 111*a* of the outer rotor 110, thereby transmitting the rotation of the engaged outer rotor 110 to the auxiliary top 130.

The winder 140 provides the inner rotor 120 with the rotation force to rotate the inner rotor 120, and has a winder body 141 of a desired length, a rack gear 142 which is formed on one side of the winder body 141 and is meshed with the pinion gear 123 of the inner rotor 120, and a finger ring 143 which is provided at a distal end of the winder body 141, and is held by a user. The rotation force is applied to the inner rotor 120 by pulling the winder 140 in a horizontal direction.

The operation of the spinning top according to the first embodiment of the present invention will now be described.

If the winder body 141 is inserted into the winder receiving hole 113 of the outer rotor 110 in the state in which the user holds the finger ring of the winder 140, the pinion gear 123 of the inner rotor 120 is meshed with the rack gear 142 formed on one side of the winder body 141.

If the user pulls the winder 140 in the state in which the user holds the outer rotor 110, the rotation shaft 121 of the inner rotor 120 and the rotor 122 are rotated by the pinion gear 123.

When the outer rotor 110 is put on the ground, the rotation shaft 121 of the inner rotor 120 rubs against the engaging groove 111*a* of the outer rotor 110 to cause the outer rotor 110 to generate the centrifugal force, so that the outer rotor 110 is rotated.

Also, the outer rotor 110 is put in the auxiliary top 130 in such a way that the engaging boss 133 of the auxiliary top 130 is fitted into the engaging hole 111 of the outer rotor 110. After that, if the auxiliary top 130 is put on the ground in the state in which the outer rotor 110 is engaged to the auxiliary top 130, the rotation shaft 121 of the inner rotor 120 rubs against the engaging groove 111*a* of the outer rotor 110, and the centrifugal force is produced on the outer rotor 110, so that the outer rotor 110 and the auxiliary top 130 rotate together.

Second Embodiment

Figure 5:
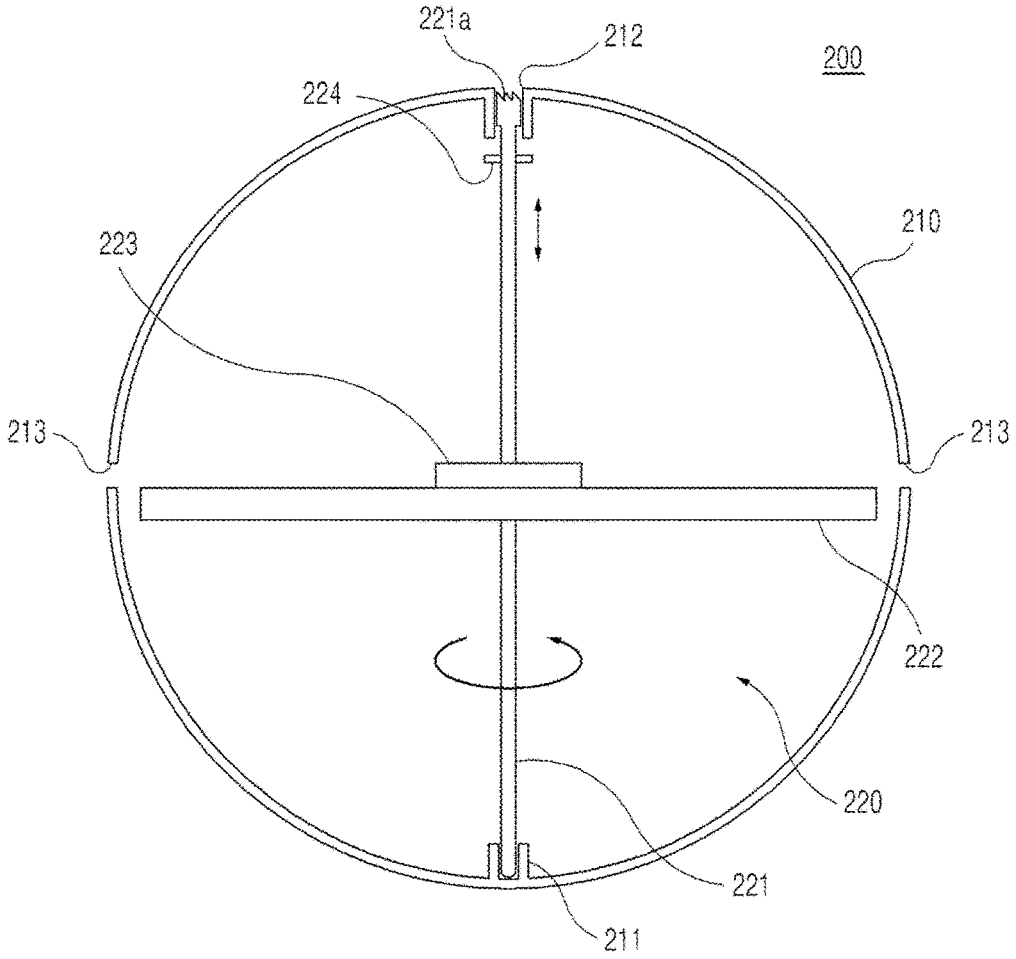
FIG. 5 is a cross-sectional view illustrating a spinning top according to a second embodiment of the present invention.
Figure 6:
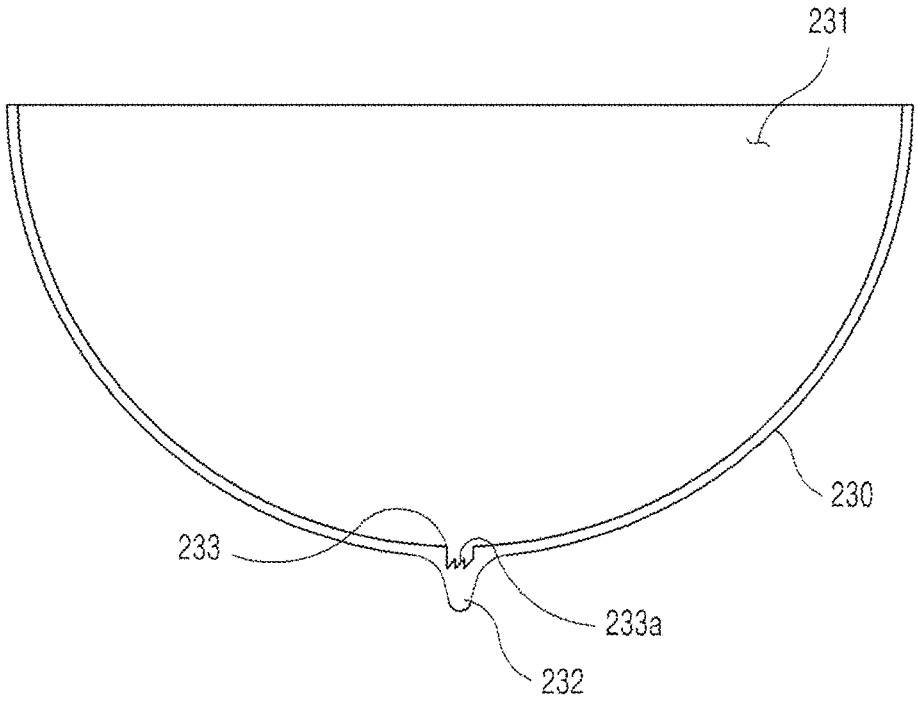
FIG. 6 is a cross-sectional view illustrating the configuration of an auxiliary top of the spinning top in FIG. 5.

FIG. 5 is a cross-sectional view illustrating a spinning top according to the second embodiment of the present invention. FIG. 6 is a cross-sectional view illustrating the configuration of an auxiliary top of the spinning top in FIG. 5.

As illustrated in FIGS. 5 and 6, a spinning top 200 according to the second embodiment includes an outer rotor 210, an inner rotor 220, an auxiliary top 230, and a winder 140 (see FIG. 1).

The outer rotor 210 is a spherical member with an accommodation space therein, and is rotated by a centrifugal force of the inner rotor 220 installed therein.

The outer rotor 210 is provided with a rotation shaft support 211 at an inner lower portion thereof so as to rotatably support a rotation shaft 221, so that the centrifugal force of the inner rotor 220 is transmitted to the outer rotor 210. The outer rotor 210 is provided with a rotation shaft through-hole 212 at an inner upper portion thereof so as to rotatably support a portion of the rotation shaft 221 of the inner rotor 220, so that when the outer rotor 210 is turned over, a portion of the rotation shaft 221 protrudes through the rotation shaft through-hole 212.

Also, the outer rotor 210 is provided with a plurality of winder receiving holes 213 on a side thereof to receive the winder 140 (see FIG. 1). The winder 140 is meshed with the inner rotor 220 installed in the outer rotor.

The inner rotor 220 is installed in the outer rotor 210 to be able to rotate therein, and has a disc-shaped rotor 222 installed to the rotation shaft 221. The rotor 222 is rotated in the outer rotor 210 on the basis of the rotation shaft 221 so as to create the centrifugal force, which causes the spinning top 200 to spin.

One side of the rotation shaft 221 is formed with an engaging boss 221*a* of a desired shape, and the engaging boss 221*a* is engaged an engaging groove 233 of the auxiliary top 230, thereby transmitting the rotation force of the inner rotor 220 to the auxiliary top 230.

Also, the inner rotor 220 has a pinion gear 223 which is installed to the rotation shaft 221 and is meshed with a rack gear 142 (see FIG. 1) of the wider 140 (see FIG. 1) to convert a linear motion of the winder 140 into a rotary motion, so that the rotation shaft 221 is rotated.

The inner rotor 220 has a stopper 224 installed to one side of the rotation shaft 221 which is formed with the engaging boss 221*a*. When the outer rotor 210 is turned over, the topper 224 prevents the engaging boss 221*a* of the rotation shaft 221 from protruding outwardly over a desired distance from the outer rotor 210.

The auxiliary top 230 is a hemispherical member with an accommodation space therein, and a portion of the outer rotor 210 is seated in the auxiliary top 230. The auxiliary top 230 is rotated by rotation of the outer rotor 210, and has an outer rotor accommodating groove 231, an auxiliary top rotation shaft 232, and an engaging boss 233.

The outer rotor accommodating groove 231 is a hemispherical space in which the lower portion of the outer rotor 210 is seated.

The auxiliary top rotation shaft 232 protrudes in a desired length from a bottom surface of the outer rotor accommodating groove 231. When the auxiliary top 230 is rotated by the centrifugal force of the inner rotor 220, the auxiliary top 230 rotates around the auxiliary top rotation shaft 232.

The engaging groove 233 is formed on the bottom surface of the outer rotor accommodating groove 231, and is engaged to the engaging boss 221*a* of the rotation shaft 221 of the inner rotor 220 which is seated in the outer rotor accommodating groove 231, thereby transmitting the rotation of the engaged inner rotor 220 to the auxiliary top 230.

The operation of the spinning top 200 according to the second embodiment of the present invention will now be described.

If the winder 140 is inserted into the winder receiving hole 213 of the outer rotor 210 in the state in which the user holds the finger ring of the winder 140 (see FIG. 1), the pinion gear 223 of the inner rotor 220 is meshed with the rack gear 142 formed on one side of the winder 140.

If the user pulls the winder 140 out in the state in which the user holds the outer rotor 210, the rotation shaft 221 of the inner rotor 220 and the rotor 222 are rotated by the pinion gear 223.

When the outer rotor 210 is put on the ground, with the rotation shaft through-hole 212 facing upward, the rotation shaft 221 of the inner rotor 220 rubs against the rotation shaft support 211 of the outer rotor 210 to cause the outer rotor 210 to generate the centrifugal force, so that the outer rotor 210 is rotated.

When the outer rotor 210 is rotated together with the auxiliary top 230, the outer rotor 210 is turned over in such a way that the rotation shaft through-hole 212 faces downward, and the engaging boss 221*a* of the rotation shaft 221 protrudes outwardly in a desired distance through the rotation shaft through-hole 212.

When the inverted outer rotor 210 is seated in the auxiliary top 230, the protruding engaging boss 221 is engaged to the engaging groove 233 of the auxiliary top 230, and thus the outer rotor 210 are rotated together with the auxiliary top 230 by the rotation force produced by the inner rotor 220.

Third Embodiment

Figure 7:
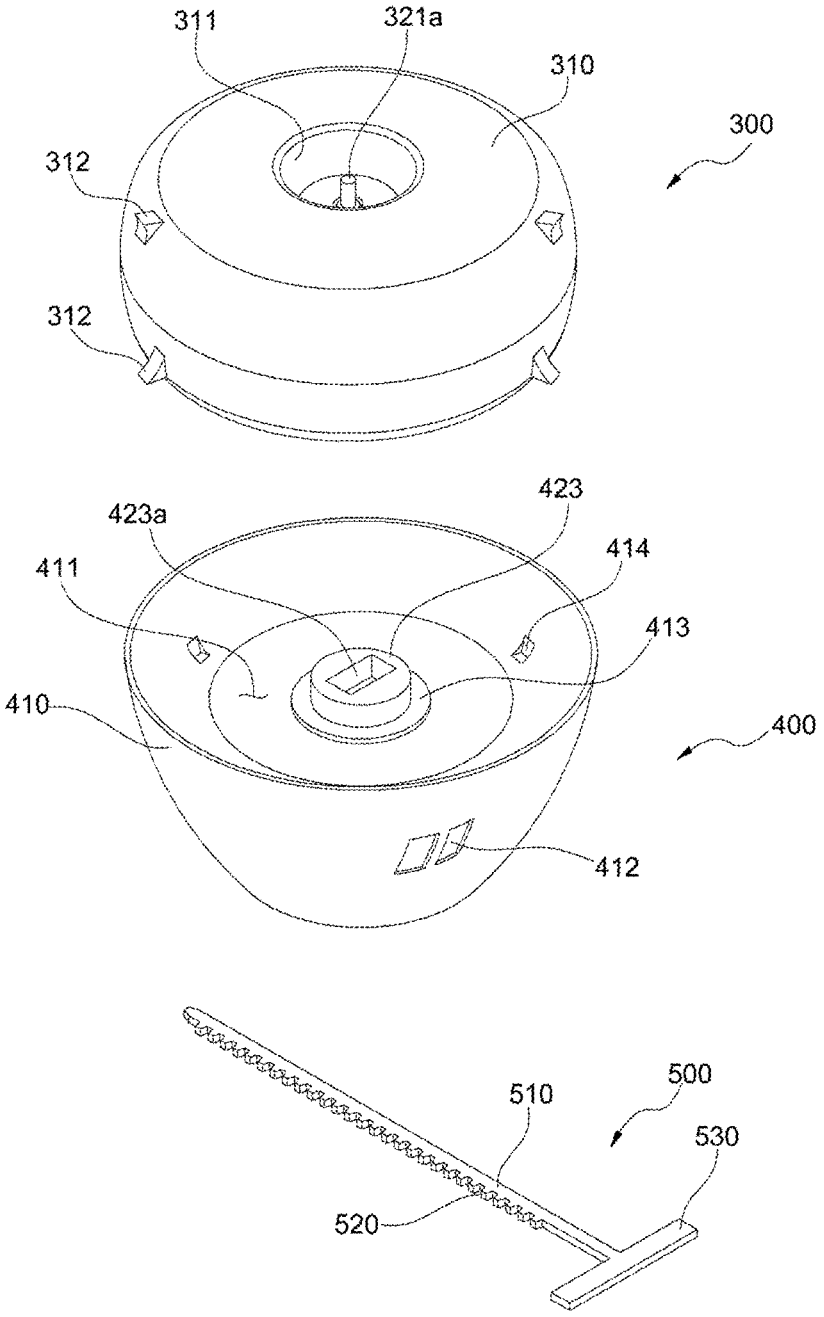
FIG. 7 is a perspective view illustrating a spinning top according to a third embodiment of the present invention.
Figure 8:
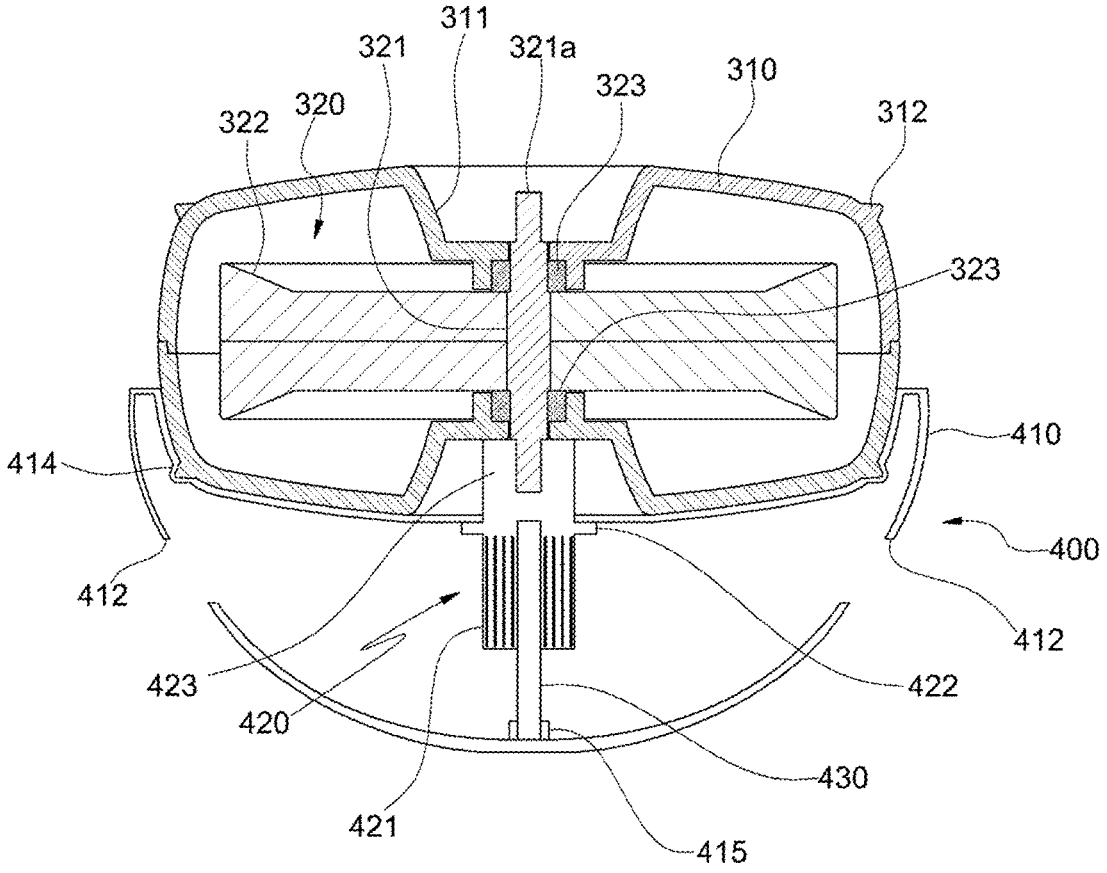
FIG. 8 is a cross-sectional view of the spinning top in FIG. 7.
Figure 9:
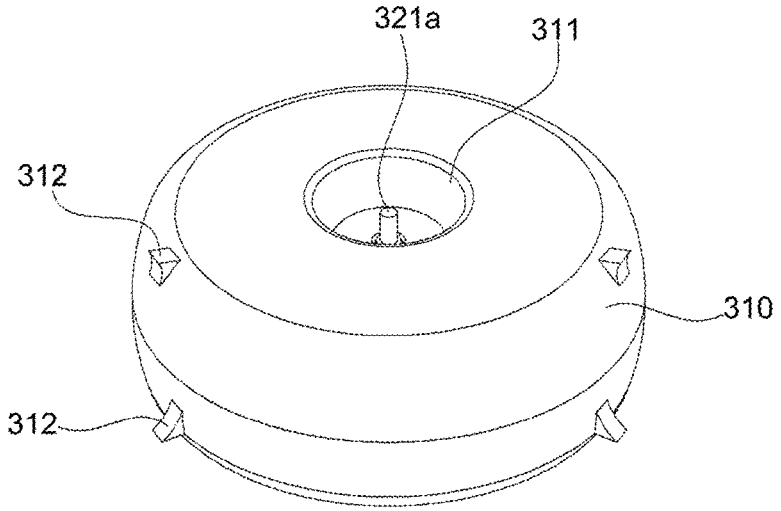
FIG. 9 is a perspective view illustrating an auxiliary top and the spinning top in FIG. 7.
Figure 9:
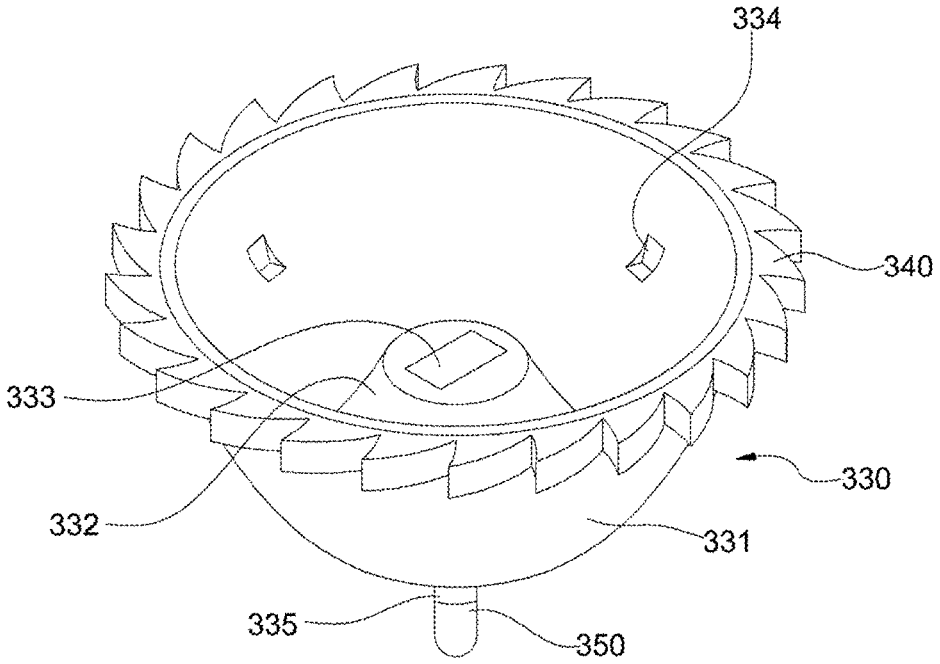
Figure 10:
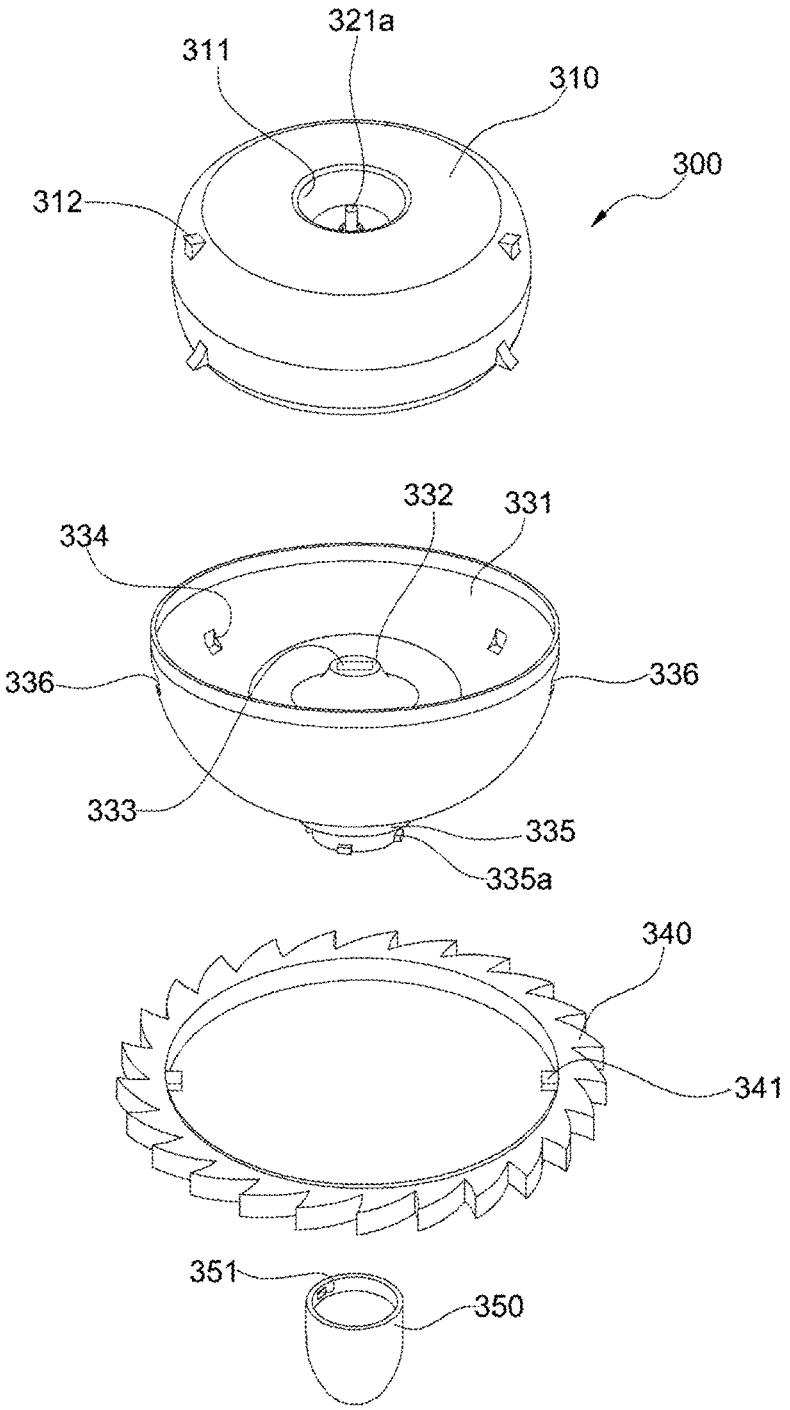
FIG. 10 is an exploded perspective view illustrating the configuration of the auxiliary top and the spinning top in FIG. 9.
Figure 11:
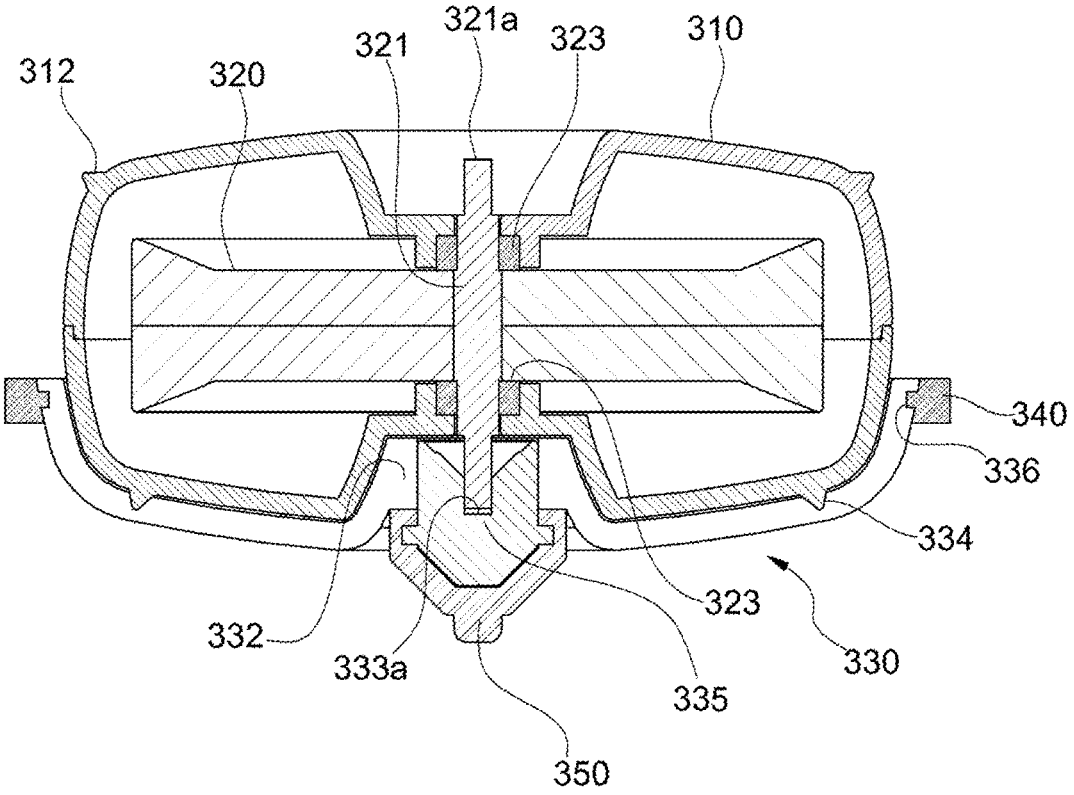
FIG. 11 is a cross-sectional view illustrating the configuration of the auxiliary top and the spinning top in FIG. 9.

FIG. 7 is a perspective view illustrating a spinning top according to the third embodiment of the present invention. FIG. 8 is a cross-sectional view of the spinning top in FIG. 7. FIG. 9 is a perspective view illustrating an auxiliary top and the spinning top in FIG. 7. FIG. 10 is an exploded perspective view illustrating the configuration of the auxiliary top and the spinning top in FIG. 9. FIG. 11 is a cross-sectional view illustrating the configuration of the auxiliary top and the spinning top in FIG. 9.

As illustrated in FIGS. 7 to 11, a spinning top 300 according to the third embodiment includes an outer rotor 310, an inner rotor 320, an auxiliary top 330, a collision ring 340, a bottom 350, a top launcher 400, and a winder 500.

The outer rotor 310 is a spherical or elliptical member with an accommodation space therein, and is rotated by a centrifugal force of the inner rotor 320 installed therein.

The outer rotor 310 is provided with a concave engaging hole 311 at each center of upper and lower portions which is engaged to the auxiliary top 330 or the top launcher 400. Also, the outer rotor 330 is provided with at least one protrusion 312 formed on an outer peripheral surface thereof for preventing the outer rotor 310 from freely moving when the outer rotor is engaged to the auxiliary top 330 or the top launcher 400.

The inner rotor 320 is installed in the outer rotor 310, and is configured to rotate around the rotation shaft 321 penetrating the outer rotor 310. The inner rotor 320 has the rotation shaft 321, a rotor 322, and a bearing 323.

The rotation shaft 321 is a cylindrical member which penetrates the engaging hole 311 of the outer rotor 310 and protrudes in a desired length therefrom. Upper and lower ends of the rotation shaft 321 are formed with an insert 321*a* of, for example, a rectangular shape, respectively, which is engaged to the auxiliary top 330 or the top launcher 400.

Although in this embodiment the shape of the insert 321*a* has been explained to have the rectangular shape for the sake of easy explanation, the present invention is not limited thereto. The shape may be applied to a polygonal shape, such as a triangle or a pentagon, and the insert 321*a* may be formed of a shaft having a cross-shaped section to penetrate in a horizontal direction.

The rotor 322 is a disc member which is installed to the rotation shaft 321, and is rotated around the rotation shaft 321 in the outer rotor 310 to produce the centrifugal force.

The bearing 323 is sandwiched between the engaging hole 311 of the outer rotor 310 and the rotation shaft 321, so that the rotation shaft 321 and the rotor 322 can smoothly rotate.

The auxiliary top 330 is a hemispherical member with an accommodation space therein, and the outer rotor 310 is seated in the auxiliary top 330. The auxiliary top 330 is engaged to the rotation shaft 321 of the inner rotor 320, and is rotated by rotation of the outer rotor 110. The auxiliary top 330 has an outer rotor accommodating groove 331, an outer rotor seat 332, a rotation shaft receiving portion 333, protrusion engaging grooves 334, a bottom engaging portion 335, a collision ring engaging groove 336, the collision ring 340, and the bottom 350.

The outer rotor accommodating groove 331 is a groove which is formed in the hemispherical auxiliary top 330, and the outer rotor 310 is seated in the outer rotor accommodating groove 331.

The outer rotor seat 332 is a member protruding in a desired distance from a center of the bottom surface of the outer rotor accommodating groove 331, and is seated in the engaging hole 311 of the outer rotor 310, so that the outer rotor 310 is seated in the auxiliary top 330.

The rotation shaft receiving portion 333 is formed with a receiving groove 333*a* at an upper end of the outer rotor seat 332, and the rotation shaft 321 of the inner rotor 320 is fitted in the rotation shaft receiving portion 333.

The protrusion engaging grooves 334 are a plurality of grooves formed on the inner peripheral surface of the outer rotor accommodating groove 331, and are engaged to the protrusions 312 of the outer rotor 310 to prevent the outer rotor 310 from freely moving in the auxiliary top 330.

The bottom engaging portion 335 is formed at the lower end of the auxiliary top 330, so that the bottom 350 for rotatably supporting the auxiliary top 330 can be fixed to the auxiliary top 330. A plurality of bottom engaging protrusions 335*a* protrude from the outer peripheral surface of the bottom engaging portion 335.

The collision ring engaging groove 336 is formed on the outer peripheral surface of the auxiliary top 330 to have a desired size, so that the collision ring 340 can be installed and fixed to the outside of the auxiliary top 330.

The collision ring 340 is a ring-shaped member made of plastic resin or metal material, and is installed to the outer peripheral surface of the auxiliary top 330 to be able to attach to or detach from the auxiliary top 330, so as to apply the impact to an opponent spinning top upon collision between two spinning tops or produce impact sound, thereby further enhancing amusement at the spinning top play.

The bottom 350 is detachably installed to the lower portion of the outer rotor accommodating groove 331 of the auxiliary top 330 to form the rotation shaft of the auxiliary top 330. The bottom 350 is engaged to the bottom engaging portion 335 to support the auxiliary top 330 to be able to rotate.

The bottom 350 is formed with a bottom receiving groove 351 to which the bottom engaging protrusions 335*a* of the bottom engaging portion 335 is fixed, so that a user can selectively replace the bottom 350.

Specifically, by changing the shape of the bottom 350 to the other shape, such as a cone, a cylinder, or a sphere, motion of the auxiliary top 330 can be changed depending upon the shape of the bottom.

Figure 12:
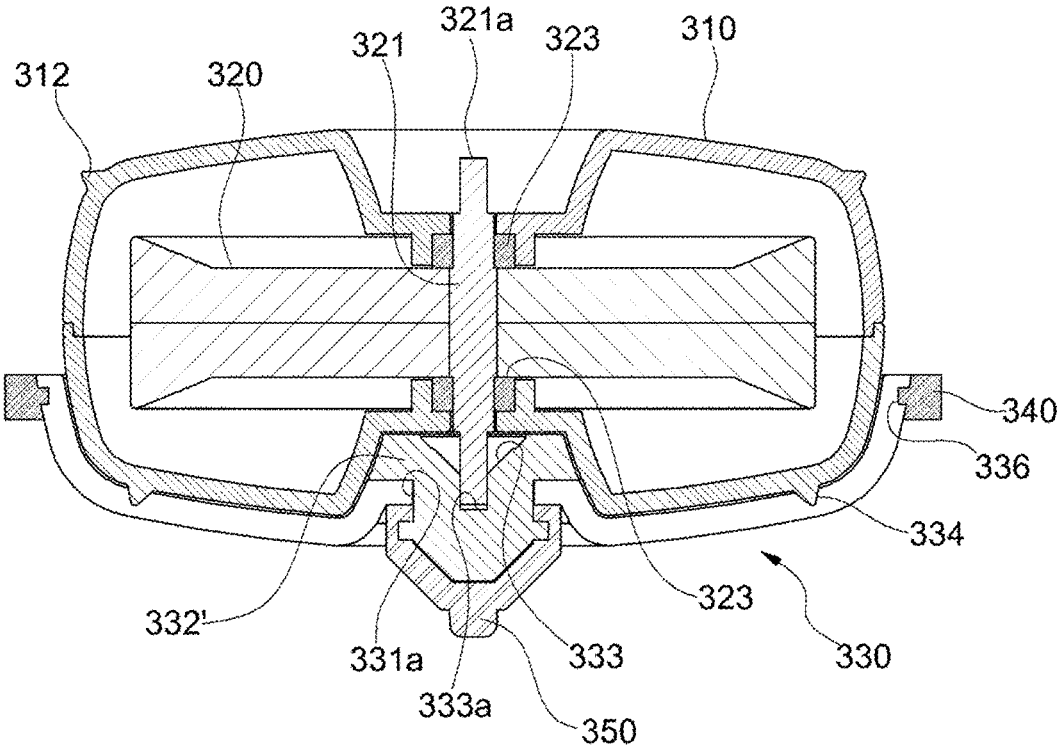
FIG. 12 is a cross-sectional view illustrating another example of the auxiliary top and the spinning top in FIG. 9.

Meanwhile, the outer rotor seat 332' can be configured to be separated from the outer rotor accommodating groove 331, as illustrated in FIG. 12.

Specifically, the outer rotor seat 332' is formed integrally with the bottom engaging portion 335, and the bottom surface of the outer rotor accommodating groove 331 is formed with a through-hole 331*a*. The bottom engaging portion 335 of the outer rotor seat 332' penetrates through the through-hole 331*a* so as to be engaged to the bottom 350, thereby replacing the bottom 350.

The top launcher 400 is a hemispherical member with a receiving space therein, and the outer rotor 310 is seated in the top launcher 400. The top launcher 400 is formed with a plurality of winder receiving holes 412 through which the winder 500 passes. The top launcher 400 is configured to engage to the rotation shaft 321 of the inner rotor 320 and convert the linear motion of the winder 500 into the rotary motion, thereby rotating the inner rotor 320. The top launcher 400 has a top launcher body 410, a pinion gear 420, and a rotation shaft 430.

The top launcher body 410 is a hemispherical member formed with a receiving groove therein, and has an outer rotor receiving portion 411 in which the outer rotor 310 is seated, a plurality of winder receiving holes 412 into which the winder 500 is inserted, a through-hole 413 through which an upper end of the pinion gear 420 protrudes, and protrusion engaging grooves 414 to which the protrusions 312 of the outer rotor 310 are engaged so as to prevent the outer rotor 310 from freely moving in the top launcher 400.

The pinion gear 420 has a pinion gear body 421 which is rotatably installed in the top launcher body 410, and is provided with a pinion gear formed on an outer peripheral surface thereof, a flange 422 which is formed on an upper portion of the pinion gear body 421 so that the pinion gear body 421 does not pass the through-hole 413, and an engaging portion 423 which is formed on the upper portion of the pinion gear body 421 and is engaged to the rotation shaft 321 of the inner rotor 320.

The rotation shaft 430 is installed in a rotation shaft fixing groove 415 of the top launcher body 410 to support the pinion gear 420 to be able to rotate.

Figure 13:
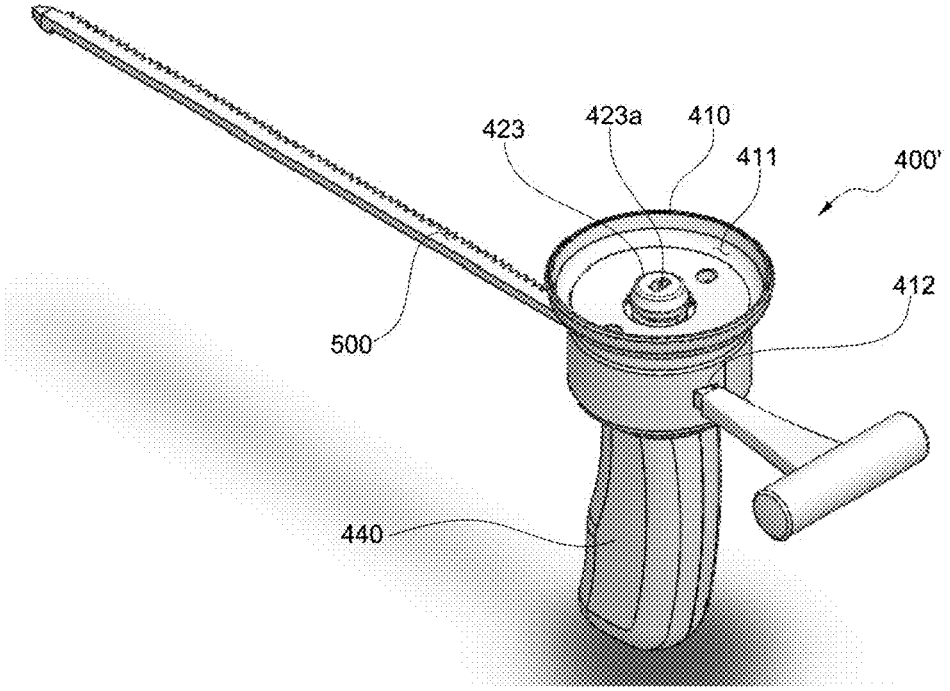
FIG. 13 is a perspective view illustrating another example of a top launcher in FIG. 7.
Figure 14:
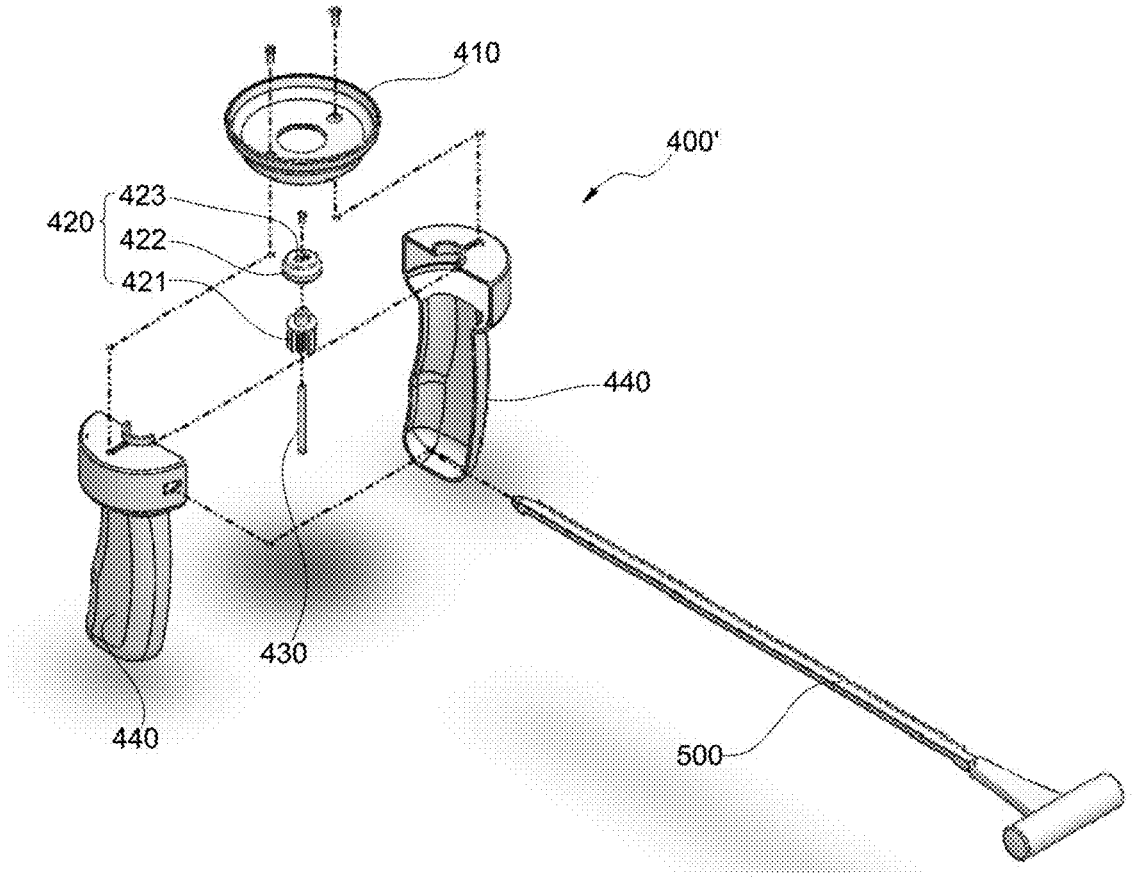
FIG. 14 is an exploded perspective view illustrating the configuration of the top launcher in FIG. 13.

FIG. 13 is a perspective view illustrating another example of the top launcher in FIG. 7. FIG. 14 is an exploded perspective view illustrating the configuration of the top launcher in FIG. 13.

As illustrated in FIGS. 13 and 14, a top launcher 400' has a top launcher body 410, a pinion gear 420, a rotation shaft 430, a rotation shaft 430, and a grip portion 440 formed at a lower portion of the top launcher body 410 so that the user can easily grip the top launcher.

Referring again to FIGS. 7 to 11, the winder 500 provides the inner rotor 320 with the rotation force to rotate the inner rotor 320, and has a winder body 510 of a desired length, a rack gear 142 which is formed on one side of the winder body 510 and is inserted into the top launcher 400 through the winder receiving hole 412 to mesh with the pinion gear 420 of the top launcher 400, and a finger ring 530. If the finger ring 530 of the winder 500 is pulled out in the meshing state to convert the linear motion of the rack gear into the rotary motion, the inner rotor 320 is provided with the rotation force to be able to rotate in the outer rotor 310.

After the winder 500 is inserted in the top launcher 400 in which the spinning top 300 is installed, the winder 500 is pulled out to rotate the inner rotor 320. In this instance, if the outer rotor 310 is seated in the auxiliary top 330 by a user's hand, the rotation shaft 321 is engaged to the rotation shaft receiving portion 333 of the auxiliary top 330, and thus the outer rotor 310 and the auxiliary top 330 are rotated by the rotation force produced by the inner rotor 320.

(Spinning Top Play Device)

Figure 15:
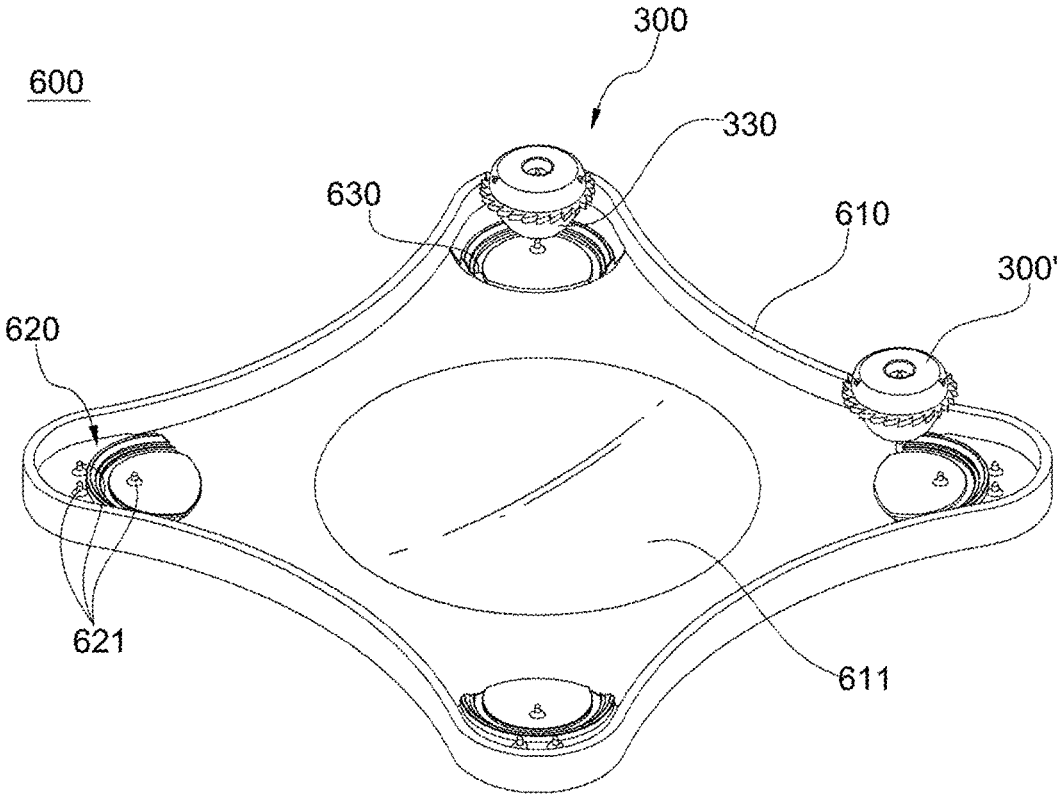
FIG. 15 is a perspective view illustrating a spinning top play device using the spinning top according to the present invention.

FIG. 15 is a perspective view illustrating a spinning top play device using the spinning top according to the present invention.

As illustrated in FIGS. 7 to 11 and FIG. 15, the spinning top play device using the spinning top according to the present invention includes the spinning top 300 and a spinning top station 600.

The spinning top 300 includes the outer rotor 310 with the receiving space therein, the inner rotor 320 which is installed in the outer rotor 310, in which the rotor 322 is rotated around the rotation shaft 321 in the outer rotor 310, and the auxiliary top 330 which is engaged to the rotation shaft 321 of the inner rotor 320 and is rotated with the inner rotor, in which a portion of the outer rotor 310 is seated.

The spinning top station 600 is configured so that a plurality of spinning tops 300 and 300' move and collide with each other, and includes a spinning top station body 610, spinning top seats 620, and guides 630.

The spinning top station body 610 is formed with a concave slope portion 611 at a center thereof along which the spinning top 300 moves.

A plurality of spinning top seats 620 are installed along the circumference of the spinning top station body 610, and have a plurality of supports 621 protruding from the top seating parts so that the auxiliary top 330 does not fall down. Therefore, the auxiliary top 330 can be seated on the spinning top seat 620 to maintain the stable position.

The guide 630 is a semicircular groove for connecting the spinning top station body 610 and the spinning top seat 620. The bottom 350 of the auxiliary top 330 seated in the spinning top seat 620 is placed in the groove of the guide 630, and if the auxiliary top 330 seated in the spinning top seat 620 is engaged to and rotated with the outer rotor 310, the bottom 350 of the auxiliary top 330 is rotated to move along the guide 630, so that the auxiliary top is guided to the spinning top station body 610.

The operation of the spinning top play device using the spinning top according to the present invention will now be described.

After the spinning top station 600 is placed at a desired location, the auxiliary top 330 is seated on the support 621 of the spinning top seat 620. In this instance, the bottom 350 of the auxiliary top 330 is placed in the groove of the guide 630.

The user puts the engaging hole 311 of the outer rotor 310 on the pinion gear 420 of the launcher 440 in such a way that the rotation shaft 321 of the inner rotor 320 is engaged to the engaging portion 423 of the launcher 400, and then inserts the winder 500 into the launcher 400.

If the user pulls the winder 500 out, the rotation shaft 321 is rotated by the pinion gear 420 of the launcher 400, and the inner rotor 320 is rotated in the outer rotor 310.

The user separates the outer rotor 310, in which the inner rotor 320 rotates, from the launcher 400, and seats the outer rotor 310 on the auxiliary top 330 so that the outer rotor seats 332 of the auxiliary top 330 are inserted into the engaging holes 311 of the outer rotor 310. The rotation shaft 321 of the inner rotor 320 is engaged to the rotation shaft receiving portion 333 of the auxiliary top 330 to rotate the auxiliary top 330.

As the auxiliary top 330 rotates, the spinning top 300 including the outer rotor 310, the inner rotor 320, and the auxiliary top 330 rotates around the bottom 350 of the auxiliary top 330 as a fulcrum. The spinning top 300 separated from the support 621 moves along the guide 630 from the spinning top station 620 to the spinning top station body 610 by the centrifugal force of the spinning top 300, thereby playing the spinning top game at the center of the spinning top station body 610, in which some spinning tops collide with each other.

Since the rotor of the spinning top is not exposed to the outside, the rotation force of the rotor is kept for a long period of time even at the collision. Also, the connection between the outer rotor and the auxiliary top can enhance the amusement at the spinning top play. In addition, a plurality of spinning tops can be admitted to the spinning top station at the same time to collide with each other, thereby further enhancing the amusement at the spinning top play.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

In each of the drawings used in the above description, the thickness of the lines or the scale of each element is modified appropriately in order to make it recognizable. In addition, it is noted that in this embodiment some terminologies are arbitrary defined and used in view of the function thereof, and are not limited as long as they can attain the present invention since those terminologies can be varied depending upon intention of users or operators.

BRIEF DESCRIPTION OF REFERENCE NUMERALS

100, 200, 300: Spinning Top
110, 210, 310: Outer Rotor
111: Engaging Hole
111*a*: Engaging Groove
113, 213: Winder Receiving Hole
120, 220, 320: Inner Rotor
121, 221: Rotation Shaft
122, 222: Rotor
123, 223: Pinion Gear
130, 230, 330: Auxiliary Top
131, 231: Outer Rotor Accommodating Groove
132, 232: Auxiliary Top Rotation Shaft
133: Engaging Boss
133*a*: Patterned Portion
140, 500: Winder
141, 510: Winder Body
142, 520: Rack Gear
143, 530: Finger Ring
211: Rotation Shaft Support
212: Rotation Shaft Through-hole
221*a*: Engaging Boss
224: Stopper
233: Engaging Groove
233*a*: Patterned Portion
311: Engaging Hole
312: Protrusion
321: Rotation Shaft
321*a*: Insert
322: Rotor
323: Bearing
331: Outer Rotor Accommodating Groove
332: Outer Rotor Seat
333: Rotation Shaft Receiving Portion
333*a*: Receiving Groove
334: Protrusion Engaging Groove
335: Bottom Engaging Portion
335*a*: Bottom Engaging Protrusion
336: Collision Ring Engaging Groove
340: Collision Ring
341: Collision Ring Engaging Boss
350: Bottom
351: Bottom Receiving Groove
400: Spinning Top Launcher
410: Spinning Top Launcher Body
411: Outer Rotor Receiving Portion
412: Winder Receiving Hole
413: Through-hole
414: Protrusion Engaging Groove
415: Rotation Shaft Fixing Groove
420: Pinion Gear
421: Pinion Gear body
422: Flange
423: Engaging Portion
423*a*: Receiving Groove
600: Spinning Top Station

610: Spinning Top Station Body
611: Slope
620: Spinning top Seat
621: Support
630: Guide

The invention claimed is:

1. A spinning top comprising:

an outer rotor having an accommodation space, and the outer rotor being provided with a plurality of winder receiving holes through which a winder passes;

an inner rotor installed in the outer rotor and the inner rotor is rotated around a rotation shaft in the outer rotor;

an auxiliary top comprising an outer rotor accommodating groove to receive the outer rotor, and an auxiliary too rotation shaft extending outwards from a bottom portion of the outer rotor accommodating groove; and the winder is provided with a rack gear formed on one side of the winder, the winder being inserted through a winder receiving hole of the outer rotor and being meshed with the inner rotor to provide the inner rotor with a rotation force to rotate in the outer rotor, wherein the outer rotor is rotated by a centrifugal force of the inner rotor.

2. The spinning top according to claim 1, wherein the auxiliary top is rotated by at least one of rotation of the outer rotor or rotation of the inner rotor.

3. The spinning top according to claim 2, wherein the outer rotor has engaging holes formed in upper and lower portion of a spherical or elliptical shape to engage with the auxiliary top, and each engaging hole having an engaging groove.

4. The spinning top according to claim 2, wherein the outer rotor has an rotation shaft support formed at an inner lower portion of a spherical or elliptical shape to support the rotation shaft of the inner rotor, and a rotation shaft through-hole formed in an inner upper portion of a spherical shape, through which a portion of the rotation shaft protrudes.

5. The spinning top according to claim 1, wherein the auxiliary top further comprise an engaging boss provided at the outer rotor accommodating groove, and the engaging boss being engaged to the outer rotor that is received in the outer rotor accommodating groove to transmit rotation of the engaged outer rotor to the auxiliary top.

6. The spinning top according to claim 1, wherein the auxiliary top further comprises an engaging groove provided at the outer rotor accommodating groove, and the engaging groove being engaged to the rotation shaft that protrudes in a desired distance from the outer rotor.

7. The spinning top according to claim 1, wherein the inner rotor comprises:

the rotation shaft, a rotor installed to the rotation shaft, and a pinion gear installed to the rotation shaft to convert a linear motion of the winder into a rotary motion and to output the rotary motion to the rotation shaft.

8. The spinning top according to claim 1, wherein the inner rotor comprises:

the rotation shaft with an engaging boss formed at one side of the rotation shaft, a rotor installed to the rotation shaft, a pinion gear installed to the rotation shaft to convert a linear motion of the winder into a rotary motion and to output the rotary motion to the rotation shaft, and a stopper installed to one side of the rotation shaft to prevent the engaging boss of the rotation shaft from protruding outwardly over a distance from the outer rotor.

9. A spinning top comprising:

an outer rotor having an accommodation space;

an inner rotor installed in the outer rotor and rotated around a rotation shaft in the outer rotor, the rotation shaft penetrating the outer rotor;

a top launcher receiving the outer rotor, and the top launcher being formed with a plurality of winder receiving holes through which a winder passes, the top launcher being engaged to the rotation shaft of the inner rotor to convert a linear motion of the winder into a rotary motion to rotate the inner rotor; and the winder being provided with a rack gear formed on one side of the winder, the winder being meshed with the top launcher to provide the inner rotor with a rotation force to rotate in the outer rotor.

10. The spinning top according to claim 9, further comprising an auxiliary top that receives the outer rotor and is engaged to the rotation shaft of the inner rotor.

11. The spinning top according to claim 10, wherein the auxiliary top further comprises a collision ring detachably installed to an outer peripheral surface of the auxiliary top.

12. The spinning top according to claim 10, wherein the auxiliary top comprises an outer rotor accommodating groove to receive the outer rotor;

an outer rotor seat protruding in a distance from a bottom surface of the outer rotor accommodating groove, and the outer rotor seat being provided with a rotation shaft receiving portion to be engaged to the rotation shaft of the inner rotor (320), the rotation shaft receiving portion being formed with a receiving groove; and a bottom installed to a lower portion of the outer rotor accommodating groove to form a rotation shaft of the auxiliary top.

13. The spinning top according to claim 12, wherein the outer rotor seat is formed integrally with a bottom engaging portion engaged to the bottom, and the outer rotor seat is detachably installed to the bottom surface of the outer rotor accommodating groove.

14. The spinning top according to claim 12, wherein the bottom is detachably installed to the outer rotor accommodating groove.

15. The spinning top according to claim 9, wherein the outer rotor is formed in a spherical shape or an elliptical shape, and is provided with at least one protrusion formed on an outer peripheral surface of the outer rotor.

16. The spinning top according to claim 9, wherein the inner rotor comprises the rotation shaft, a rotor installed to the rotation shaft, and a bearing installed between the rotation shaft and the outer rotor.

17. The spinning top according to claim 9, wherein the top launcher comprises:

a top launcher body having an outer rotor receiving portion to receiving the outer rotor and a plurality of winder receiving holes into which the winder is inserted;

a pinion gear rotatably installed in the top launcher body, and being provided with an engaging portion to engage to the rotation shaft of the inner rotor, and a pinion gear formed on an outer peripheral surface thereof; and an rotation shaft to support the pinion gear to be able to rotate in the top launcher body.

18. A spinning top play device comprising:

a spinning top comprising an outer rotor with a receiving space, an inner rotor installed in the outer rotor, and having a rotor rotated around a rotation shaft in the outer rotor, and an auxiliary top engaged to the rotation shaft of the inner rotor, with a portion of the outer rotor being seated in the auxiliary top;

a spinning top station body formed with a concave slope portion at a center along which the spinning top moves;

spinning top seats installed on the spinning top station body, each spinning top seat having supports that seat the spinning top, and the supports extending outwards from the spinning top seats; and a guide connecting the spinning top station body and the spinning top seats to guide movement of the spinning top seated on the spinning top seat to the spinning top station body.

* * * * *